United States Patent [19]

Hsu

[11] Patent Number: 4,884,615

[45] Date of Patent: Dec. 5, 1989

[54] SOUND ABSORBENT SLATS FOR WINDOW BLINDS

[76] Inventor: Henry C. Hsu, 29-42 162th St., Flushing, N.Y. 11358

[21] Appl. No.: 249,705

[22] Filed: Sep. 27, 1988

[51] Int. Cl.[4] ..... E06B 9/00

[52] U.S. Cl. ..... 160/236; 87/6

[58] Field of Search ..... 160/236; 350/263, 320; 428/74, 265; 87/6; 139/384 A, 389, 387

[56] References Cited

U.S. PATENT DOCUMENTS

| | | | |
|---|---|---|---|
| 2,315,640 | 4/1943 | Morse et al. | 160/236 |
| 3,472,305 | 10/1969 | Lefes | 160/236 |
| 4,139,043 | 2/1979 | Donofrio | 160/236 |
| 4,336,834 | 6/1982 | Schaller | 160/236 X |
| 4,499,938 | 2/1985 | Toti | 160/236 |

FOREIGN PATENT DOCUMENTS

| | | | |
|---|---|---|---|
| WO85/00849 | 2/1985 | PCT Int'l Appl. | 160/236 |

*Primary Examiner*—Blair M. Johnson

*Attorney, Agent, or Firm*—Abelman Frayne Rezac & Schwab

[57] ABSTRACT

A slat for use in the assembly of a Venetian blind is provided with a light and sound absorptive coating on at least one of its major surfaces produced by flocking, applique, or textile weaving techniques, a preferred embodiment of the invention providing a strip having enhanced resistance to slippage of a coating appliqued to the strip and of a textile encapsulation of the strip in directions laterally and longitudinally of the strip.

7 Claims, 3 Drawing Sheets

FIG. 1
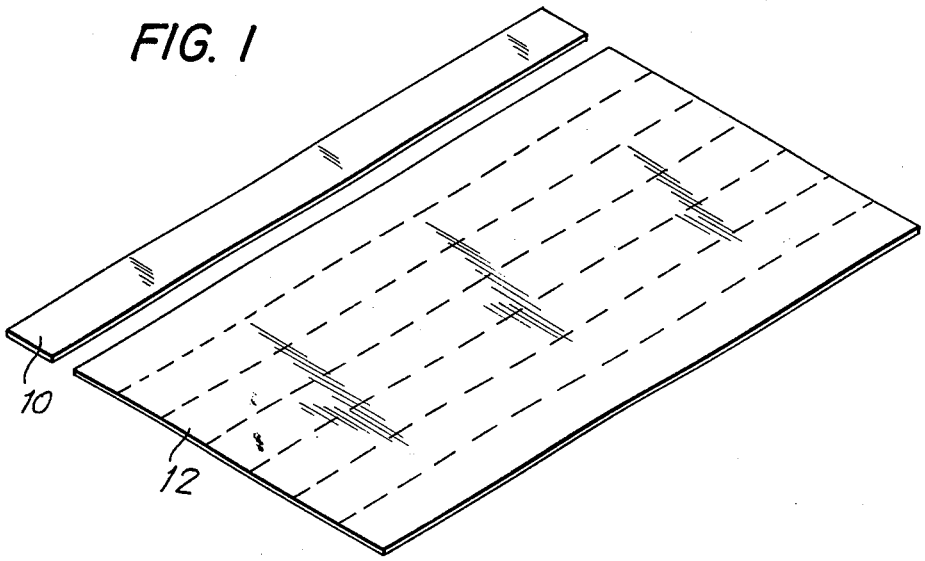
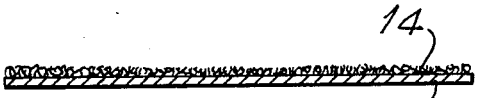
FIG. 2
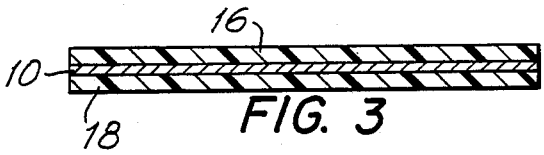
FIG. 3
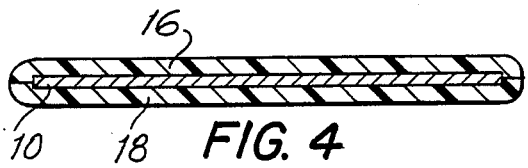
FIG. 4
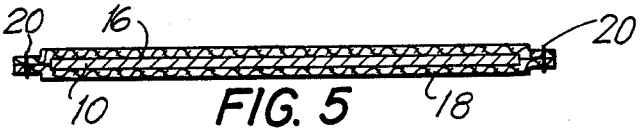
FIG. 5

FIG. 8
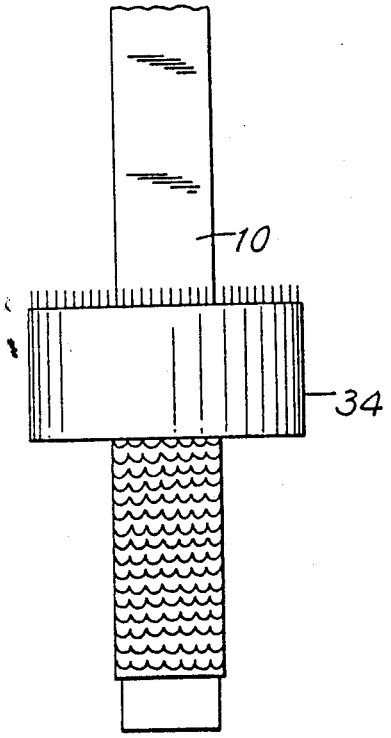
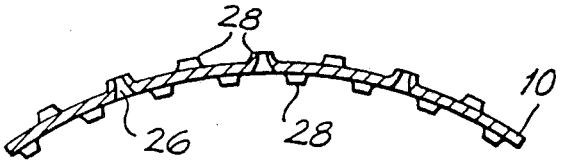
Fig. 9

SOUND ABSORBENT SLATS FOR WINDOW BLINDS

FIELD OF THE INVENTION

This invention relates to slats for use in commonly known constructions of Venetian blinds, such blinds including two or more ladder tapes or cords which support the slats in a generally horizontal attitude, provision being made for adjusting the ladder tapes to change the attitude of the slats between a generally horizontal position and a generally vertical position. The actual mechanical construction of such blinds is well-known in the art, and forms no part of this invention, the invention being directed to the manner of formation of the slats to be incorporated into such a Venetian blind construction, or, into any commonly known construction of vertical blind.

BACKGROUND OF THE INVENTION

It is known to form slats for Venetian blinds or vertical blinds from continuous strips of aluminum or plastics material, or coated paperboard material.

Commonly, the strip material employed for the fabrication of the individual slats is produced in continuous coils of several hundred feet length. A selected number of selected lengths of the continuous strip are then cut by a jobber in the process of assembling a blind of a specified width and height.

Also, it is common for the strip material to be prepainted, or, formed from a color plastics material, and, it is also common for the strip material to have been pre-formed for it to present one concave longitudinal surface and an opposite convex longitudinal surface, this being in order to increase the rigidity of a length of a strip material and to stabilize it in an axially straight condition.

The required strips are produced by conventional metal rolling and extrusion techniques, which again form no part of the present invention. Alternatively the strips can be cut from large sheets of material of an appropriate length by conventional cutting techniques.

However, the employment of such techniques results in an axially continuous surface of the strips which has an aesthetically austere appearance, and also, one which is quite highly reflective to both light and sound. This can manifest itself in dazzle due to high reflection when sun strikes the slats, and, an increase in the noise level in rooms employing such Venetian blinds.

SUMMARY OF THE INVENTION

This invention relates to such strip material as employed as slats in window blinds, and has for its object to provide slats produced in strip form, which not only have an enhanced aesthetic appearance, but which are also capable of dissipating reflected light or sound.

While the dissipation or reflected light can be enhanced to some extent by texturing the strip material, by embossing it prior to the painting thereof in order to produce a textured surface, this in no way will enhance the sound dissipation characteristics of the strip material.

In order to overcome these disadvantages, and, in accordance with the present invention, the strip material is coated on one or both of its faces with a sound absorbant material which is adhesively or mechanically bonded to the surface of the strip.

The coating can be a coating of flock fibers which can be applied under an electrostatic field, as is known in the art, or, it can be an applique of sound absorbant sheet material, applied by techniques known in the art, or, the strip material can be encapsulated within a sheath of woven textile material, which has been woven in-situ about the slat material. In this manner, a composite slat is provided having a decorative appearance, and which possesses the strength and rigidity of a conventional slat as used in Venetian blinds, while at the same time enhancing the sound absorbtion characteristics of the slat and reducing its light reflectivity.

In the event that the coating is a coating of flock fibers, the flocking can be effected before coiling of the strip, but preferably is effected subsequent to the cutting of the continuous strip into standard lengths.

Encapsulating textile material can be woven in-situ around the strip material by conventional weaving techniques, such as by braiding textile yarns around the strip material, or, by the tubular weaving of a sheath of textile material around the strip material from continuous warps extending longitudinally beneath the strip material and longitudinally above the strip material, and one or more wefts that is woven sequentially through the warps, either in the presence of or the absence of a selvedge at each longitudinal edge of the strip material.

Alternatively, the encapsulation of the strip material with textile material can be effected in a circular knitting machine, the strip material being passed axially through the knitting cylinder of the circular knitting machine in timed sequence with the knitting operation, thus producing an encapsulated strip having a stockinette, or even a Terry towelling external appearance.

The actual techniques of weaving the encapsulation are well-known in the trade in a multitude of variations. The present invention is not limited to any specific weaving technique other than it be capable of producing an encapsulating sheath on the slat material.

Further, subsequent to weaving of the encapsulation of fabric material on the slat material, conventional techniques can be employed for bonding and shrinking the fabric material onto the strip material, particularly in order to eliminate fraying and flaying of the textile fibers at the ends of the lengths of strip material ultimately cut from the continuous coil of such material by the jobber employed in the assembly of the finished Venetian blind.

Alternatively, the conventional cutting and punching machines employed by jobbers can be provided with heated cutters and punchers in order to effect heat fushion of fusible textile fibers during the actual cutting of the strip material. Electro-sonic welding also can be employed.

In this manner, a highly decorative slat can be provided, which not only is non-reflective, but also, which is of considerably enhanced sound-deadening characteristics.

Within the purview of conventional textile manufacturing techniques, slats can be provided which have any desired surface characteristics, such as that of Shantung silk, moire silk, linen, worsted, tufting, cut velvet, plisse, Terry cloth, or the like, and also plaids, tartans or ginghams or the like by the use of appropriately colored yarns.

The textile material can be heat shrunk onto the slat material, or bonded thereto by any conventional bonding technique.

Preferably, the weaving is effected with the strip material in a planar condition, subsequent to which the composite slat material is then bowed laterally for it to have the required axial rigidity, a bonding operation of the fabric encapsulation to the strip material substrate conveniently being employed at this point in the manufacture.

Some fabric materials do not lend themselves to such bonding techniques, in which event the strip material can be pre-formed and laterally bowed prior to the weaving of the textile material encapsulation around the strip material substrate. In this event, the strip material is preferably subjected to an additional forming operation prior to the weaving of the textile material encapsulation, this additional forming operation comprising punching holes through the strip material from the concave side thereof to produce jagged surface excrescences on the convex side thereof. During the subsequent weaving operation, the textile threads become matrixed with the punched excrescenses, thus immobilizing the threads against movement relative to the strip material substrate.

DESCRIPTION OF THE DRAWINGS

Preferred embodiments of the present invention will now be described with reference to the accompanying drawings, in which:

FIG. 1 is a perspective view illustrating the manner in which a large sheet of substrate material can be cut into strips for use in the assembly of a window blind;

FIG. 2 illustrates, in cross-section, one of the strips to which a coating of flocking has been applied on one surface;

FIG. 3 is a cross-section similar to FIG. 2, and showing appliques applied to both faces of the strip;

FIG. 4 is a cross-section similar to that of FIG. 3, and showing an alternative manner of encapsulating the strip material;

FIG. 5 is a cross-section similar to FIG. 4, and showing another manner of encapsulating the strip;

FIG. 8 is a diagrammatic illustration of a manner in which encapsulation of the strip can be effected in a circular knitting machine; and, FIG. 9 is a cross-section through a preferred formation of the strip.

DESCRIPTION OF THE PREFERRED EMBODIMENTS

Figure 6:
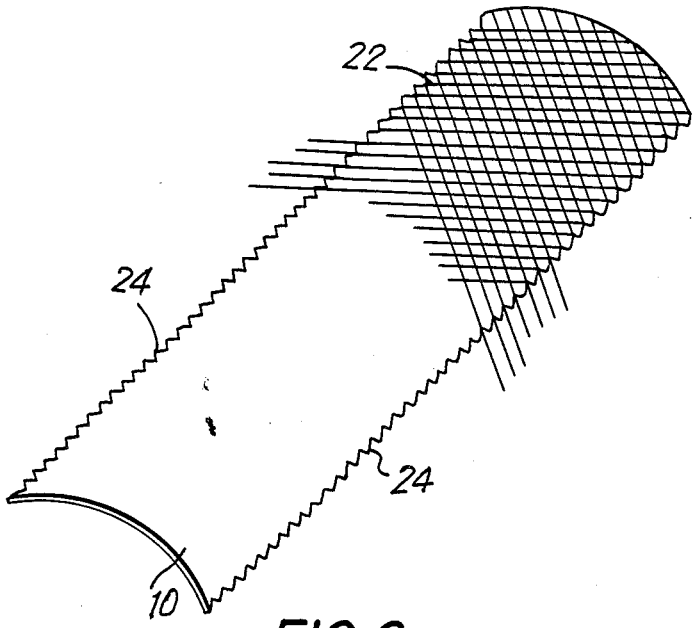
FIG. 6 is a fragmentary perspective view illustrating the manner in which braiding can be applied to the strip.

As is discussed above, the strips for formation into the slats of a window blind, can be formed of metal, or, can be formed of plastics material, or, can be formed of a coated and stabilized paperboard material, including any materials that can be conveniently manufactured in strip form, either by rolling techniques, extrusion techniques and the like.

More usually, the strip material will be formed in continuous lengths of several hundred feet, which is coiled upon itself and supplied in that form to a jobber, the jobber then cutting the continuous strip into the desired selected lengths, and punching it for the reception of the usual draw cords employed for raising and lowering the Venetian blind.

It is not, however, necessary that the strip material be supplied in continuous coiled form. Equally well, it can be supplied in strips of a determined length, which are useable by the jobber in the assembly of a standard width of Venetian blind. In this latter event, the strips can be formed, as illustrated in FIG. 1, by shearing individual strips 10 from a large sheet of material 12 having a length or width of the selected width of the Venetian blind to be assembled.

Without regard to whether the strips are supplied in continuous coil form, or, they are supplied in discrete strip form, the coating or encapsulation steps of the present invention can be performed prior to the supply of the strips to the jobber.

As illustrated in FIG. 2, one side of the strip 10 can be adhesively coated, and, while the coating is still wet or tacky have fibers of flock material attached thereto in a manner well known in the art. As will be clearly apparent, whereas only one side of the strip 10 is shown coated with flocking material in FIG. 2, both sides of the strip can be appropriately coated with a layer of flocking material, the respective layers either being of the same color or of contrasting color. Also, as well be clearly apparent, the flocking operation can be effected prior to, or subsequent to, the formation of the strip for it to be bowed laterally to provide the required slat configuration as commonly employed in Venetian blinds.

Another preferred embodiment of the invention is disclosed in FIG. 3, this involving applying coatings of light and sound absorptive materials either to one side of the strip, or, as illustrated, to both sides of the strip.

In FIG. 3, the light and sound absorptive coatings 16 and 18 are shown as appliqued to the strip, and secured thereto by any suitable bonding material. If the strip 10 is in continuous coiled form, then, the respective coatings 16 and 18 similarly can be in continuous strip form and be appliqued to the strip 10 during or immediately prior to the coiling of the composite strip. This will place the respective coatings 16 and 18 under compression, thus further assisting in the bonding of those facings to the strip 10. Alternatively, the facings 16 and 18 can be applied to a large sheet 12 and bonded thereto prior to the cutting of the sheet into strips 10 as discussed with respect to FIG. 1. This will have the advantage that, if the surfacings are patterned, the respective strips 10 emerging from the cutting operation will be pattern matched, and can be assembled into a pattern matched configuration by the jobber.

Numerous materials suggest themselves as materials suitable for use as the surfacings 16 and 18. They could, for example, be a thin felt, or a woven material, or of a foamed plastics material, or of natural or synthetic leather having either a polished or a suede finish on its outwardly presented surface. Also, and as will be appreciated, the respective surfacings 16 and 18 may themselves be comprised of a laminate, for example, of a printed plastics material facing and a foam plastics material substrate.

If the covering material is capable of being thermally formed, then, the modification of FIG. 4 can be employed. In FIG. 4, the surfacings 16 and 18 of a suitable thermo-formable plastics material are applied and bonded to the respective opposite faces of the strip 10, the surfacings being of greater width than that of the strip 10. The lateral edges of the surfacings 16 and 18 then can be welded to each other, for example, by electrosonic welding techniques for them to completely encapsulate the strip 10.

Alternatively, and as shown in FIG. 5, surfacings 16 and 18 of any appropriate material, including woven fabrics, can be applied over the strip 10, the surfacings being of greater width than the strip 10, and, the respective surfacings 16 and 18 then secured to each other by machine stitching at their lateral edges as indicated at 20.

In this manner, strips having a surface coating can be provided for subsequent formation into slats by conventional techniques.

In each of FIGS. 2 through 5, the strip material has been illustrated as being in flat planar condition, with a view to it subsequently being bowed transversely to provide the required slat formation. However, as the strip material itself is flexible and resilient, it equally well could be formed into the appropriate transversely bowed cross-section prior to the applique thereto of the surface coatings 16 and 18 or the flock material 14 of FIG. 2.

More particularly with reference to the embodiments of FIGS. 3 through 5, the transversely bowed strip can be passed around a cylinder of relatively large diameter, which will temporarily deform the relatively thin and flexible strip material into a straight condition in transverse cross-section, the strip material 10 returning to its transversely bowed condition by its inherent memory as the strip material leaves the forming cylinder.

To this point, discussion has been made exclusively with reference to manners of appliqueing surface materials to the strips. The manner in which the strips can be encapsulated with textile materials is now discussed with reference to FIGS. 6, 7 and 8.

Referring firstly to FIG. 6, a strip 10, either prior to or subsequent to its being formed for it to be bowed transversely, can be passed through a conventional braiding machine, and braiding 22 applied as an encapsulation of the strip 10 completely covering it. If the strip has been pre-bent for it to be transversely bowed, then, the braiding will hug the outer convex surface of the strip, and will extend as a chord of a circle in spaced relation relative to the concave surface of the strip, thus providing a composite structure which is a sector of a circle.

However, in view of the fact that holes must subsequently be punched in the strip to provide for the pull cords of the Venetian Blind, preferably the strip is encapsulated by the braiding prior to the strip being bent to its transversely bowed form. Also, preferably the strip 10 is coated with a thermally activatable bonding agent prior to the braiding of the encapsulation 22, in order that the braiding can be "set" on the strip subsequent to the braiding operation, in order to minimize fraying or flaying of the fibers of the braiding at the time the strip is cut to appropriate lengths and punched for it to accomodate the pull cords of the Venetian blind.

To further mitigate against the possibility of the braiding slipping axially with respect to the strip 10, the strip 10 can be provided with saw-tooth edges 24 as illustrated in FIG. 6. Also, if desired, the strip can be formed as illustrated in FIG. 10 for it to have a roughened surface produced by punching holes 26 in the strip 10 resulting in outwardly extending protrusions on one surface of the strip as illustrated, and optionally, on both surfaces of the strip. In this manner, the cords of the braiding will become impaled on the surface excrescences 28 again to further mitigate the possibility of slipping of the braiding axially of the strip 10.

Figure 7:
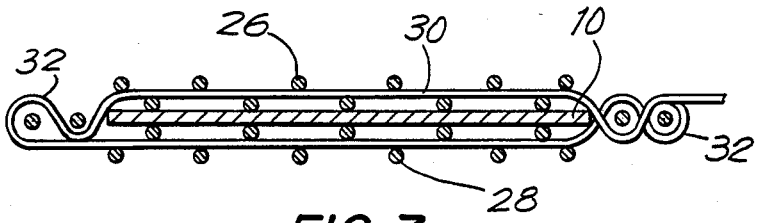
FIG. 7 is a cross-section similar to FIGS. 2–5 and illustrating the manner in which a woven encapsulation can be formed over the strip.

The strip 10 illustrated in FIG. 9 also can be employed in the formation of textile encapsulated strips, as now described with reference to FIGS. 7 and 8. In FIG. 7, the strip 10 is passed longitudinally through a weaving loom of the type employed for weaving fabrics in tubular construction. One set of warps 26 extends above the strip, and another set of warps 28 extends beneath the strip. The wefts 30 are then woven over and beneath the strip 10 in a conventional manner in order to produce a double-sided surfacing of the strip 10 having a selvedge 32 at each of its lateral edges.

Alternatively, and as illustrated in FIG. 8, the strip 10 can be passed axially through the cylinder 34 of a circular knitting machine in timed sequence with the knitting operation of the strip 10 to emerge encapsulated within a sleeve of knitted fabric. Again, the strip 10 can be of the formation discussed with respect to FIG. 9 in order to stabilize the knitted fabric axially of the strip 10. Also, as previously discussed, the strip 10 can be precoated with a thermally activatable adhesive, whereby the knit fabric can be bonded to the strip subsequent to the knitting operation.

Referring now to FIG. 9, as has previously been discussed, a strip 10 is punched through either one or both of its major surfaces to provide excrescences 28 and 28a in order to stabilize the position of the fabric material subsequently braided or woven over the strip. This technique also can be employed with advantage in the constructions of FIGS. 3, 4 and 5, in order to positionally locate the surfacings 16 and 18 during the application of those surfacings to the strip 10, the surfacings 16 and 18 being compressed onto the excrescences 28 and 28a by passing the composite strip through pinch rollers.

Various other modifications will suggest themselves to persons knowledgeable in the art, the various embodiments illustrated and discussed above being representative of preferred embodiments of the invention falling within the scope of the apended Claim.

As will be appreciated, by this invention slats for window blinds can be provided in an infinite variety of styles and surface textures, each of which is enhanced light absorbtivity over conventional slats, and which also are of enchanced sound absorbtivity over conventional Venetian blind slats. Also, the opportunity exists of providing different textures on the opposite sides of the slats, as does the possibility of producing pattern matched printings on the slats, and, the possibility of providing surface textures on the slats in an infinite variety, as produced either in the manufacture of the coatings appliqued to the slats, or in the weaving of the encapsulation of the slats. Such matters of printing, surface texturing and weaving each are well known in their specific arts, as is the technique of laminating the surface coatings in order to further enhance the sound absorptive characteristics of the slats.

I claim:

1. A sound absorbent slat for use in the construction of a window blind, said slat including a substrate in the form of a strip, and, further including a tubular sheath of woven fabric material formed in situ about said strip so as to tightly encapsulate said strip, said tubular sheath providing a continuous coating of a light and sound absorbent material on both of the major surfaces of said strip.

2. The sound absorbant slat of claim 1, in which said woven fabric material is bonded to said strip.

3. The sound of absorbent slat of claim 1, in which strip is perforated through at least one of its major surfaces to provide surface excrescences on the opposite major surface, said surface excrescences extending into said sheath of woven fabric material to positionally hold said tubular sheath against movement relative to said strip.

4. A sound absorbant slat of claim 1, in which said strip has serrated lateral edges.

5. The sound absorbent slat of claim 1, in which said tubular sheath of textile material is comprised of first textile strands extending longitudinally of said strip, and, second textile strands extending transversely of said strip and interwoven with said first strands.

6. The sound absorbent slat of claim 1, in which said tubular sheath of textile material is comprised of textile strands braided around said strip.

7. The sound absorbent slat of claim 1, in which said sheath of textile material is comprised of knitted textile strands.

* * * * *